United States Patent [19]

Brewer

[11] Patent Number: 4,492,048

[45] Date of Patent: Jan. 8, 1985

[54] LABELING KEEPER

[76] Inventor: Robert A. Brewer, 15 Castle Park Way, Oakland, Calif. 94611

[21] Appl. No.: 502,333

[22] Filed: Jun. 8, 1983

[51] Int. Cl.[3] ..... A44C 3/00

[52] U.S. Cl. ..... 40/2 R; 40/2 A; 70/456 R; 70/459

[58] Field of Search ..... 40/2 A, 2 R, 330, 10 D; 70/456 R, 457, 459, 460

[56] References Cited

U.S. PATENT DOCUMENTS

| | | | |
|---|---|---|---|
| 785,399 | 3/1905 | Brandt | 40/2 A |
| 912,225 | 2/1909 | Bachrach | 40/2 R |
| 1,114,289 | 10/1914 | Rittenhouse | 70/459 |
| 1,647,140 | 11/1927 | Ludy | 70/459 |
| 2,179,884 | 11/1939 | Falkoff | 40/2 R |
| 2,423,818 | 7/1947 | Schmutzler | 40/2 R |
| 3,715,900 | 2/1973 | Sherman | 70/456 R |
| 3,956,913 | 5/1976 | Howard | 70/456 R |
| 4,215,497 | 8/1980 | Levy | 40/10 D |
| 4,358,944 | 11/1982 | Stoffel | 70/457 |
| 4,422,315 | 12/1983 | Klose | 70/456 R |

FOREIGN PATENT DOCUMENTS

| | | | |
|---|---|---|---|
| 1223679 | 8/1966 | Fed. Rep. of Germany | 40/2 A |

OTHER PUBLICATIONS

W. H. Brady Co., Industrial Products Division, Bulletin No. MS-789 c 1982, p. 37, Front and Back Cover.

Panduit Corp., Electrical Products Group, Catalog E-CC7, c 1982, p. 28, Front and Back Cover.

*Primary Examiner*—John J. Wilson

*Attorney, Agent, or Firm*—James R. Cypher

[57] ABSTRACT

A labeling keeper including a protective sheet. The sheet is releasably attached to a backing sheet by adhesive and scored so that individual protector strips may be removed from the backing sheet. The protector strips are wrapped around an attachment member which holds the article to be identified such as a key. The attachment member is formed with an arm which holds the article. The protector strip when wrapped about the attachment member latches the arm so that the article cannot separate from the attachment member.

4 Claims, 7 Drawing Figures

LABELING KEEPER

BACKGROUND OF THE INVENTION

The most common system for labeling articles such as keys, wires or other articles is a paper tag with a string or wire loop pre-attached. The identification description or code is written on the label and the string or wire attached to the key or wire to be labeled. While the system is inexpensive and relatively easy to use, the tags become mutilated or lost if it is desired to carry the key in a pocket for any length of time. Further, such paper tags tear, or if wetted the marking is obliterated and the tab can become separated from the string or wire.

An alternate system which solved most of these problems is disclosed in my pending application U.S. Ser. No. 06/306,709 filed Sept. 29, 1981, now U.S. Pat. No. 4,425,772, issued 01/17/84. My prior labeling system, however, required time and some care in the process for identifying articles. Sinch both characteristics are in short supply and given the natural disinclination to organize such mundane items as keys, a faster and easier system was sought.

Another system entitled Article Labeling System is set forth in my application filed the same day as this application.

SUMMARY OF THE INVENTION

The present labeling system greatly reduces the time required to label articles by forming the keeper from a material that will accept markings from a writing instrument and by providing the protective plastic in a single strip of material which is affixed to the keeper in a single easily accomplished wrap-a-round step.

The labeling system uses adhesive backed elements which are easily peeled from a backing sheet.

The protector strip of the present invention serves the double purpose of providing the protection of the writing on the keeper and latching the arm used to hold the labeled items.

The labeling keeper of the present invention may be formed with various types of attachment arms so that a variety of different types of articles can be labeled including keys, individual and bundles of wires, merchandise having handles or other small attachment members such as cups, and clothing with button holes.

DESCRIPTION OF THE PREFERRED EMBODIMENTS

Figure 4:
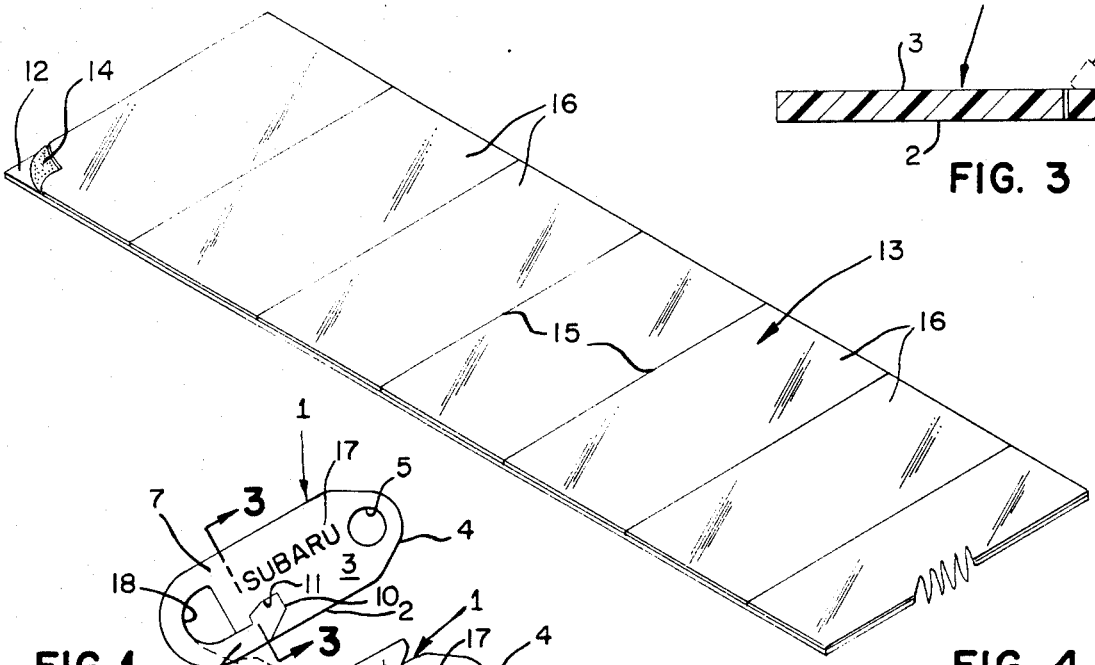
FIG. 4 is a perspective view of the protective sheet of the present invention.

The labeling keeper is constructed in the following manner. An attachment member 1 is provided having a body portion 2 presenting a display surface 3 which is manufactured from a plastic material selected to receive markings from a writing instrument. The attachment member includes an extension area 4 adjacent the display surface which is formed with an opening 5 having a dimension selected for receiving a portion of an article therethrough such as a split ring. An arm 6 is disposed from the extension area and is integrally formed from the attachment member at a location 7 adjacent the display area. The arm has a selected cross sectional area smaller than the opening in an article to be identified such as opening 8 in key 9. The arm has a distal end 10 which terminates in the display area such as cut out portion 11 when it is in the latched position.

Referring to FIG. 4, a flexible backing sheet 12 made of paper or plastic is provided. A protective sheet 13 of transparent, flexible material such as Mylar plastic having a back face 14 coated with an adhesive is removably affixed to the backing sheet. The protective sheet is formed with a plurality of transverse and parallel score lines 15 which sever the protective sheet and form a plurality of elongated protector strips 16. The purpose of the protective strip is twofold. First, it protects the writing 17 on the display surface from erasure or smudging. Second, the protective strip latches the arm by holding in place the distal end of the arm when the strip has been wound around the display area of the attachment member.

Figure 3:
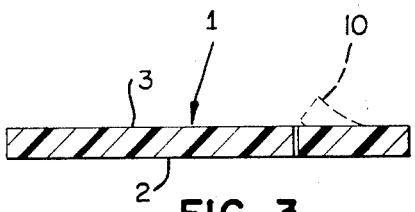
FIG. 3 is a cross sectional view on an enlarged scale of the attachment member taken along line 3—3 of FIG. 1.
Figure 1:
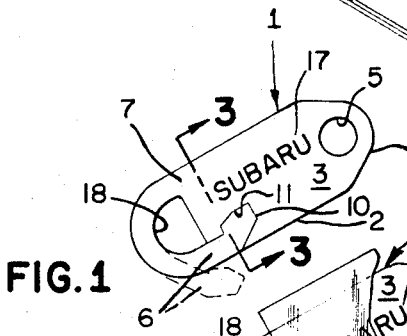
FIG. 1 is a plan view of one form of attachment member.

A unique feature of the present invention is the construction of the attachment member illustrated in FIG. 1. The attachment member is constructed from a tough plastic such as the plastic used to make Visa Cards or other types of credit cards. Such plastics can be deformed without breaking. Such materials permit the arm to be bent outwardly from the display area as shown in FIG. 3 and then returned to the display area as shown in FIG. 1. As shown in FIG. 1, the distal end of the arm is configured so that there is a mechanical locking of the distal end of the arm with the display area in which it is formed. Note that the arm forms an opening 18 of a convenient size to hold one to three keys.

Figure 2:
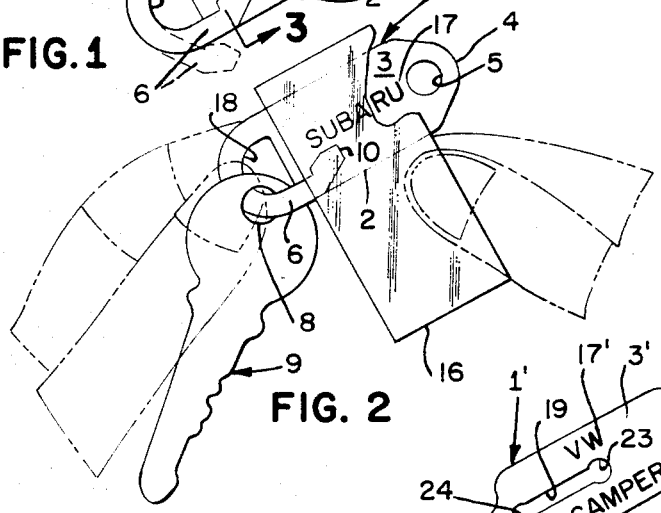
FIG. 2 is a plan view of the attachment member held in one hand and a protector strip being applied by the other hand.

Operation of the form of the invention set forth in FIGS. 1–4 is as follows. An article such as a key 9 to be indentified is selected such as a Subaru car key. An attachment member is selected. If the car is red, it is helpful to select an attachment member having a red color. The name of the article or item such as Subaru is written directly on the display surface 3 of the attachment member with a writing instrument such as a pen used to write on freezer wrap. Such pens may be found in stationery stores or even in supermarkets. Next the arm 6 of the attachment member is sprung out from the display surface and inserted through the opening 8 in the key. More than one key can be placed on the arm if desired. The distal end of the arm is then pressed back into the display surface and the arm is ready for latching. A strip 16 is peeled from the backing sheet and placed against the display surface as illustrated in FIG. 2. The pressure sensitive adhesive on the back of the protector strip adheres to the plastic attachment member. The strip should be long enough so that it can be wound completely around the attachment and overlap itself. Note that the width of the strip is selected so that it completely covers the display area but leaves the openings 18 and 5 uncovered. The attachment member may now be attached to a split ring or other organizing device.

Figure 5:
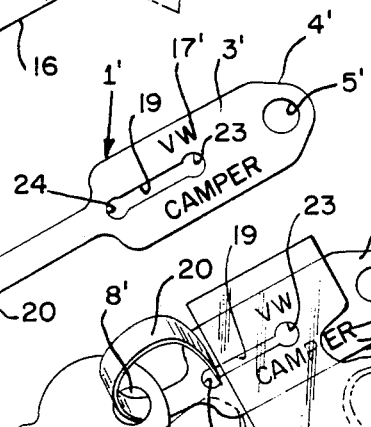
FIG. 5 is a plan view of a modified form of the invention illustrating another form of attachment member.
Figure 7:
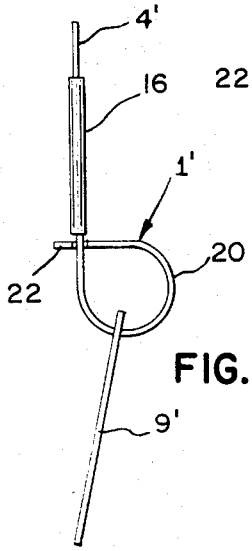
FIG. 7 is a side view of the attachment member of FIG. 6 with a protective strip secured to the member and latching the article holding arm in place.
Figure 6:
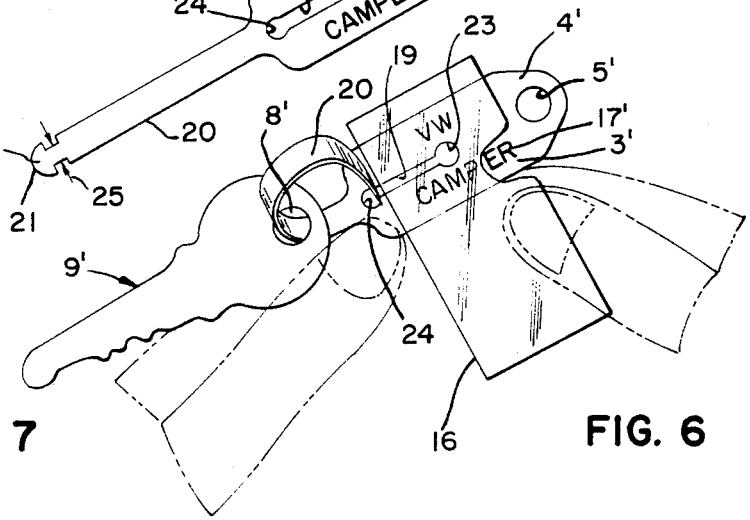
FIG. 6 is a plan view of the attachment member of FIG. 5 with a protective strip placed across the member.

Another form of attachment member 1' is illustrated in FIGS. 5–7. The display surface 3', extension area 4' and opening 5' are identical to the attachment member illustrated in FIG. 1 except that a slot 19 is formed in the display area. The arm 20 has a selected length for surrounding an object to be labeled and is formed with a distal end 21 having an enlarged head 22 for locking receipt within the slot. The slot 19 may have an enlarged opening 23 for non-interfering acceptance of head 22 at one end of the slot and another enlarged opening 24 at the other end of the slot. Enlarged opening 24 preferably has an opening size equal to the neck portion indicated by the double arrows 25. To attach the arm, it is simply necessary to bend arm 20 and insert head 22 into opening 23. Next, arm 20 and head 22 are twisted 90 degrees so that the head portion may be moved through slot 19 to opening 24. At the opening 24, the head may be released and it will return to its original position since the neck 25 and opening 24 are the same size.

The labeling system may also be used for identifying wires or a bundle of wires to help in identifying circuits. The attachment member 1' illustrated in FIGS. 5–7 is especially suited for this type of labeling application. Operation of the attachment members is as follows. First, the wires, keys or other articles to be labeled are assembled and the display surface 3' is marked as previously explained. Arm 20 is then either threaded through the opening 8' in a key 9' or wrapped around a convenient member of the article or the wire or wire bundle is encircled. Head 22 is then inserted through opening 23, the head is twisted 90 degrees and slid down slot until it reaches opening 24 where the head is permitted to return to its original position. Opening 24 now registers with neck 25. The protective strip 16 is then placed against display surface 3'. The strip is then wrapped around the attachment member 1' as previously explained. After the label is in place, it acts as a latch to prevent head 22 from being withdrawn from the slot 19 or opening 23. The attachment member may then be attached to a split ring device or other type of assembly device.

I claim:

1. A labeling keeper comprising:

a. an attachment member having a body portion presenting a display surface area which is manufactured from a plastic material selected to receive erasable markings from a writing instrument;

b. said attachment member includes an extension area adjacent said display surface area formed with an opening having a dimension selected for receiving a portion of an article organizer therethrough;

c. an arm disposed from said extension area and integrally connected to said attachment member at a location adjacent said display area and having a distal head end adapted for insertion through an opening in an article to be indentified and forming an opening separate from said display area;

d. locking means formed in said distal head of said arm;

e. latching means formed in said display area of said body portion dimensioned and formed for interlocking with said locking means;

f. a transparent, flexible, protective strip having a back face coated with an adhesive selectively encircling said body portion of said attachment member for covering said markings on said display surface; and g. said protective strip selectively covers said locking means and latch means for preventing said distal head end of said arm from separating from said display area of said attachment member.

2. A labeling keeper as described in claim 1 wherein: said distal head end of said arm is formed from material in said display surface area.

3. A labeling system as described in claim 2 wherein: said distal head end is formed with an enlarged head for mechanically preventing withdrawal of said distal end from said display area.

4. A label as described in claim 1 wherein:

a. said display surface is formed with a slot therein; and b. said arm member has a selected length for surrounding an object to be labeled and is formed with a distal end having an enlarged head for locking receipt with said slot.

* * * * *